US005190173A

United States Patent [19]

Mautino et al.

[11] Patent Number: 5,190,173

[45] Date of Patent: Mar. 2, 1993

[54] ADJUSTABLE BLOCKOUT APPARATUS

[75] Inventors: Peter S. Mautino, Verona; Douglas Hanes, Pittsburgh, both of Pa.

[73] Assignee: McConway & Torley Corporation, Pittsburgh, Pa.

[21] Appl. No.: 826,627

[22] Filed: Jan. 28, 1992

[51] Int. Cl.[5] ..... B61G 9/00

[52] U.S. Cl. ..... 213/62 R

[58] Field of Search ..... 213/67 R, 67 A, 68, 213/69, 70, 71, 72, 75 R, 50, 56, 61, 62 R, 64

[56] References Cited

U.S. PATENT DOCUMENTS

| | | | |
|---|---|---|---|
| 2,452,015 | 10/1948 | Kinne et al. | 213/67 R |
| 3,716,146 | 2/1973 | Altherr | 213/67 R |
| 4,531,648 | 7/1985 | Paton | 213/50 |
| 4,555,033 | 11/1985 | Miller | 213/51 |
| 4,580,686 | 4/1986 | Elliott | 213/62 A |
| 4,700,853 | 10/1987 | Altherr et al. | 213/50 |
| 4,846,358 | 7/1989 | Rhen | 213/64 |
| 5,080,242 | 2/1992 | Steffen et al. | 213/69 |

FOREIGN PATENT DOCUMENTS

| | | | |
|---|---|---|---|
| 1258258 | 8/1989 | Canada | 213/61 |

*Primary Examiner*—Robert J. Oberleitner
*Assistant Examiner*—Kevin D. Rutherford
*Attorney, Agent, or Firm*—James Ray & Associates

[57] ABSTRACT

An axially adjustable blockout apparatus positionable in a draft gear pocket of a yoke to allow equipping a railway car with a slackless drawbar coupling arrangement. The apparatus has a pair of spaced end blocks, a pair of spaced wedge members disposed between such end blocks and a threaded member engageable with each of the wedge members for adjustable securing a confronting pair of wedge members together a slidable connection provided to connect the wedge members with the end blocks.

19 Claims, 5 Drawing Sheets

ADJUSTABLE BLOCKOUT APPARATUS

CROSS-REFERENCE TO RELATED APPLICATIONS

This patent application is related to patent application Ser. No. 7,827,149 titled "Yoke for Coupling Railway Cars Utilizing a Drawbar Assembly" and application Ser. No. 7/826,797 titled "An Adjustable Securing Device", each filed Jan. 28, 1992, and each of which applications is assigned to the same assignee as this case.

FIELD OF THE INVENTION

The present invention relates, in general, to blockout devices positioned in a draft gear assembly pocket of a yoke used in a slackless drawbar coupling arrangement for connecting the adjacent ends of a pair of railway freight cars together in a substantially semi-permanent manner and, more particularly, this invention relates to an axially adjustable blockout apparatus for use in maintaining a substantially slack free connection between such interconnected pair of railway cars.

BACKGROUND OF THE INVENTION

The railroad locomotives used, in the railroad industry, prior to the introduction of the more powerful and efficient diesel engine in such locomotives, were in most cases generally underpowered. Therefore, it was usually necessary to provide each end of a railway freight car with a draft gear assembly. This was required in order for these underpowered locomotives to start a train consist, having a number of cars, in motion. As is known in the railway art, these draft gear assemblies were used to provide a requisite amount of slack in the coupling arrangement between the adjacent ends of several such freight cars making up the train consist. This slack, as is generally well known in the railway art, enabled start-up movement of the lead car and, thereafter, each of the following cars in succession. In other words, during start-up of the train consist the locomotive would begin taking up the slack between it and the lead car first. Thereafter the available slack in each following car, in turn, would be taken up. This start-up procedure enabled the generally lower powered locomotive to gain sufficient initial momentum to start the train consist in motion.

Furthermore, in the railway art, it is equally well known that at least a portion of the buff and draft forces which are generated and then applied to the railroad freight cars in such a coupling arrangement, during in track operation of the train consist, were normally absorbed by these draft gear assemblies. It is common practice in this coupling arrangement for such draft gear assemblies to be mounted in a draft gear pocket located in a yoke disposed within the center sill member of the railway freight car. The yoke is connected to the railway car coupler mechanism by means of a striker plate casting.

Nevertheless, these prior art type coupling arrangements resulted in detrimental dynamic loading on both the car body members and their contents. These dynamic loadings almost always result in considerable wear of the various components of the coupling mechanism disposed on the freight car and depending upon the contents being transported by such freight car such dynamic loadings can even result in damage to such contents. It is obvious that wear of the various coupling components will require considerable maintenance to be carried out so that the car can remain in service. It is further obvious that such maintenance is costly.

However, since the introduction of the more powerful diesel locomotive, in the modern railroad industry, it has been discovered that the slack formerly required in the older style coupling arrangements, is no longer necessary to start the train consist in motion. A diesel locomotive, in other words, provides the capability of starting the movement of a train consist, containing multiple freight cars, without the need for considerable amounts of slack being provided by the draft gear assemblies in the prior art car coupling arrangements. As a result, slackless drawbar assemblies have generally come into widespread use in the railroad industry as the coupling arrangement for joining together the adjacent ends of a pair of railway freight cars in a substantially semi-permanent manner. It has been demonstrated that these slackless drawbar assemblies enable the buff and draft forces which are generated by in-track movement to be distributed throughout the car center sill member to all of the railway cars making up such train consist with less damage to both the freight car components and cargo.

SUMMARY OF THE INVENTION

The present invention provides an axially adjustable blockout apparatus for use in a railway freight car coupling arrangement. The adjustable blockout device forms a portion of a slackless drawbar assembly which connects the adjacent ends of a pair of railway freight cars together in a substantially semi-permanent fashion. This axially adjustable blockout apparatus is positionable within the draft gear pocket of a yoke disposed within a center sill member of a railway car body. The adjustable blockout apparatus has a pair of spaced end blocks and a pair of spaced wedge members, with the spaced wedge members being slidably connected to the spaced end blocks and an adjustable device is provided to secure the pair of spaced wedge members together. The spaced end blocks each have a top wall, a bottom wall, a pair of end walls, a pair of side walls, and confronting end faces. The confronting end faces have an inclined surface along at least a portion thereof which extends from a respective top or bottom wall of each of the pair of end blocks towards an intermediate section thereof. The pair of spaced wedge members, which are slidably disposed between the spaced end blocks, each have a pair of side walls, an outer wall, an inner wall which confronts the inner wall of the other wedge member, and a pair of end walls which converge from the outer wall to the inner wall. An adjustable securing device adjustably secures the confronting pair of spaced wedge members together, while the spaced wedge members are also slidably connected to the pair of end blocks, with the converging end walls of the spaced wedge members contacting a respective inclined surface of a confronting end face of an end block. The slidable connection between the pair of spaced wedges members and the pair of spaced end blocks is preferably effected by means of outwardly extending flanges on confronting end faces of the end blocks and a tongue provided on the end walls of the spaced wedge members, with a key member provided on the tongue that engages an angular surface of each outwardly extending flange. The adjustable securing device for securing the pair of spaced wedge members together comprises coaxial threaded bores through the spaced wedge members and a threaded member extending between and through the coaxial bores and threadably engaged therewith. The bores are threaded in opposite directions and the threaded member has a threaded portion adjacent each end which is threadable with the bores, such that upon rotating the threaded member in one direction, the spaced wedge members will be moved together, to push the pair of end blocks sport, while upon rotating the threaded member in the other direction, the spaced wedge members will be moved apart to pull together the pair of spaced end blocks.

OBJECTS OF THE INVENTION

It is, therefore, one of the primary objects of the present invention to provide an axially adjustable blockout apparatus which can be retrofitted in a draft gear pocket of a yoke to enable installation of a slackless drawbar coupling arrangement in a railway car.

Another object of the present invention is to provide an axially adjustable blockout apparatus which will minimize wear on the coupler components in a slackless drawbar coupling arrangement.

Still another object of the present invention is to provide an axially adjustable blockout apparatus which can be easily retrofitted into an existing slackless drawbar coupling arrangement.

Yet another object of the present invention is to provide an axially adjustable blockout apparatus which will reduce maintenance cost.

A further object of the present invention is to provide an axially adjustable blockout apparatus which is easy to adjust.

An additional object of the present invention is to provide an axially adjustable blockout apparatus which can withstand forces of up to one million pounds being exerted thereon.

In addition to the various objects and advantages of the present invention described above, it should be obvious that various other objects and advantages of the axially adjustable blockout apparatus will become more readily apparent to those persons skilled in the railway coupling art from the following more detailed description of the invention, particularly, when such description is taken in conjunction with the attached drawings and the appended claims.

BRIEF DESCRIPTION OF THE INVENTION

Figure 1:
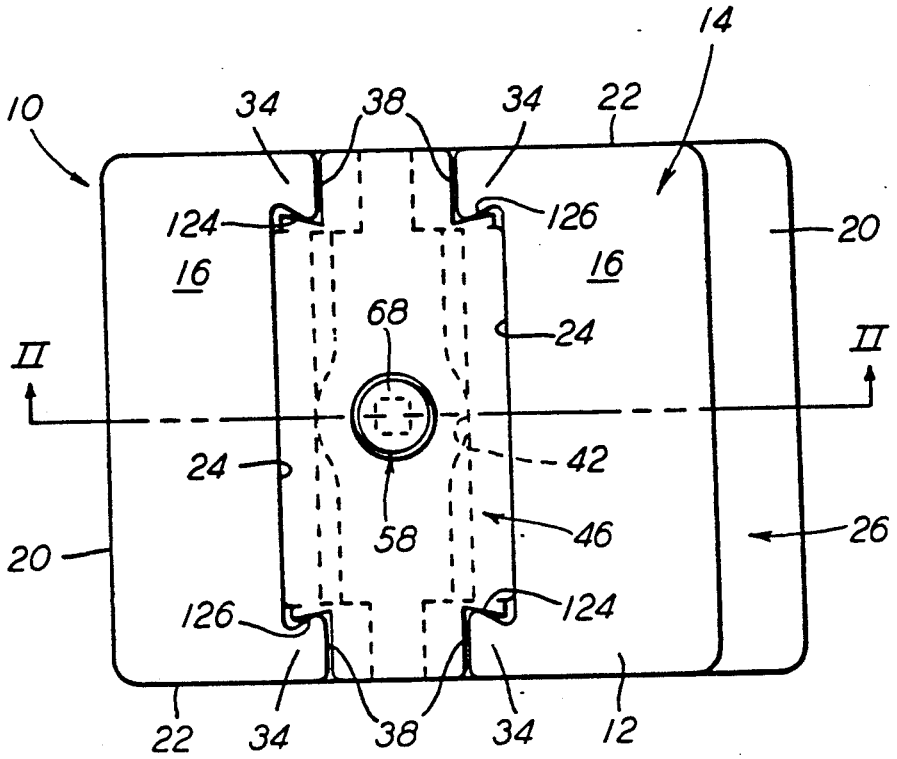
FIG. 1 is a top plan view of a draft gear pocket axially adjustable blockout apparatus, according to a presently preferred embodiment of invention.

Prior to proceeding to a more detailed description of the various preferred and alternative embodiments of the present invention it should be noted that, for the sake of clarity, identical components which have identical functions have been identified with identical reference numerals throughout the several views illustrated in the drawings.

Figure 2:
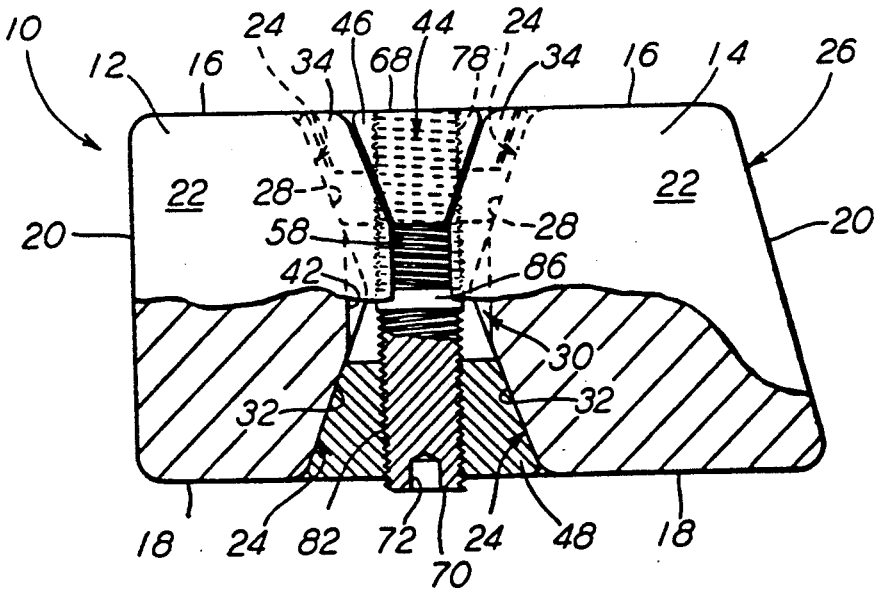
FIG. 2 is a view, partially in cross-section, taken along lines II—II of FIG. 1.
Figure 3:
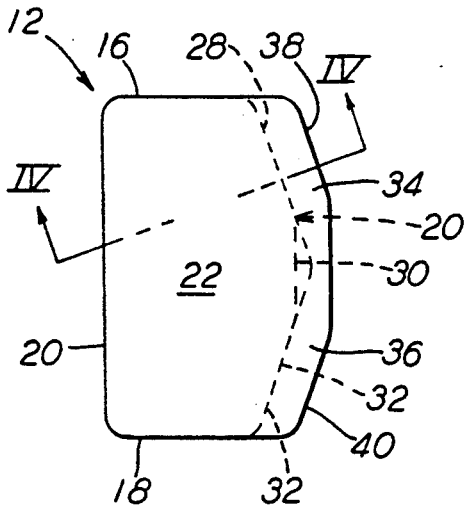
FIG. 3 is a side elevational view of one of the spaced end blocks.
Figure 5:
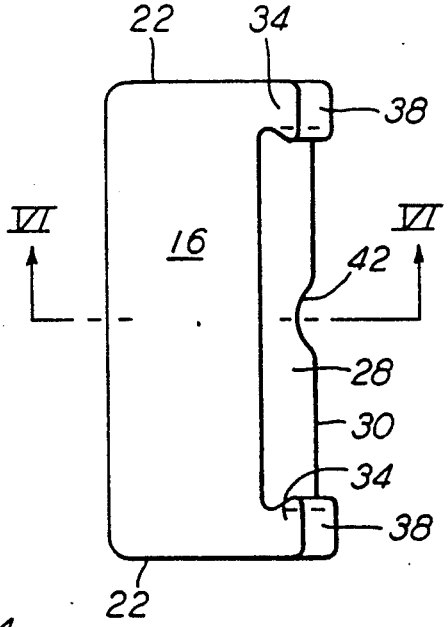
FIG. 5 is a top plan view of the end block illustrated in FIG. 3.
Figure 6:
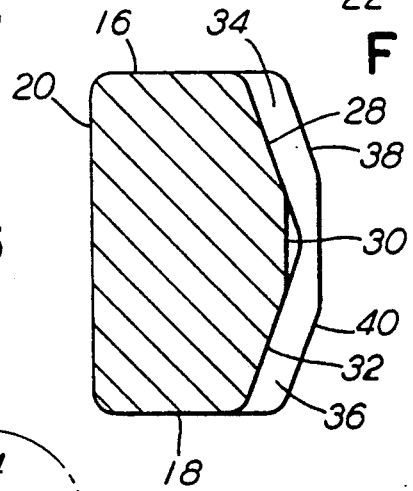
FIG. 6 is a cross-sectional view taken along lines VI—VI of FIG. 5.
Figure 4:
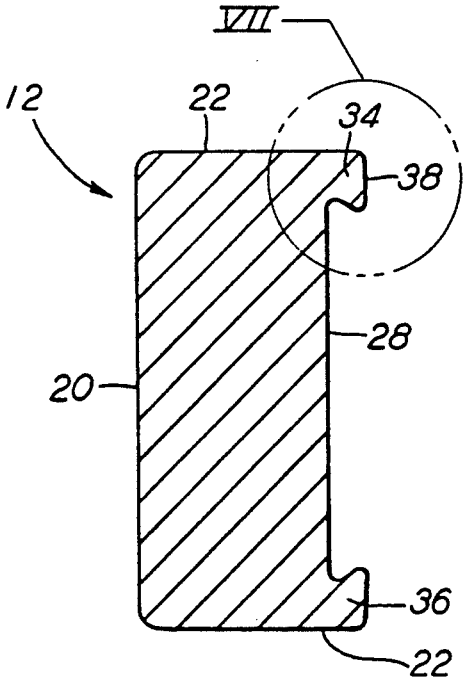
FIG. 4 is a cross-sectional view taken along lines IV—IV of FIG. 3.

Referring now to the drawings, a draft gear pocket axially adjustable blockout apparatus, generally designated 10, is illustrated. The axially adjustable blockout apparatus 10 includes a pair of spaced end blocks 12 and 14. Each of the spaced end blocks 12 and 14 has a top wall portion 16, a bottom wall portion 18, an end wall portions 20, a pair of side wall portions 22 and a confronting end face portion 24 which is axially opposed to the confronting end face portion 24 of the other spaced end block. The spaced end blocks 12 and 14 are preferably steel castings meeting AAR Specification, M-211, Grade "E". The end wall portion 20 of at least one of the spaced end blocks 12 and 14 preferably has an angular surface 26 forming an acute angle with the bottom wall portion 18. The confronting end face 24 of each of the pair of spaced end blocks 12 and 14 has a first inclined surface 28 along at least a portion of the end face 24 converging towards a confronting inclined surface 28 (FIG. 2) of the confronting end face 24 of the other spaced end block, from the top wall portion 16 towards an intermediate section 30 of the end face 24, and a second inclined surface 32 along at least a portion of the end face 24 converging towards a confronting inclined surface 32 of the confronting end face 24 of the other spaced end block, from the bottom wall portion 18 towards the intermediate section 30 of the end face 24.

In the presently preferred embodiment of the axially adjustable blockout apparatus 10, illustrated in FIGS. 1 to 12, flanges 34 and 36 respectively are provided on each of the inclined surfaces 28 and 32 respectively of the end faces 24 of spaced end blocks 12 and 14, which flanges 34 and 36 are adjacent the side wall portions 22 and extend outwardly from the confronting end faces 24 toward each other, with the outer surfaces 38 and 40 respectively of the flanges 34 and 36 respectively being parallel to the inclined surfaces 28 and 32, respectively, of the end faces 24. The intermediate section 30 of the blocks 12 and 14 may have an arcuate groove 42 formed therein. As can be seen in FIG. 1, each of the flange 34 has an undercut portion defined by angular face 124 which, as described later, cooperates with a complementary tongue or dovetail tenon having an angular face 126 and provided on wedge shaped member 46 to adjustably secure the spaced end blocks 12 and 14 to the wedge shaped member. The undercut portion of the flange together with the end faces 28 form a dovetail mortise to slidable receive a complementary portion of the wedge shaped member to form an adjustable dovetail mortise and tenon slidably retaining the spaced end blocks 12 and 14. In like manner, flanges 36 have undercut portions which taken with end faces 32 of the end blocks form a dovetail mortise which engages a dovetail tenon formed by tongues or tenons on the wedge shaped member 48.

An axially adjustable securing device, generally designated 44, is provided for adjustably securing the pair of confronting spaced end blocks 12 and 14 together. Referring now to FIGS. 13–22, a presently preferred adjustable securing device 44 comprises a first wedge shaped member 46 and spaced second wedge shaped member 48. The first wedge shaped member 46 has an inner wall portion 50 and an outer wall portion 52, while the second wedge shaped member 48 has an inner wall portion 54 and an outer wall portion 56, with the spaced wedge shaped members 46 and 48 secured together in confronting relationship by use of a threaded member 58, with the inner wall portions 50 and 54 spaced from and confronting each other.

A first threaded bore 60 is formed through the first wedge shaped member 46 which extends between and through the inner and outer wall portions 50 and 52, having threads 62 which are formed in one predetermined direction, either left or right handed threads. A second threaded bore 64 is formed through the second wedge shaped member 48 which extends between and through the inner and outer wall portions 54 and 56 thereof, having threads 66 which are formed in the opposite direction of the threads 62 of the first threaded bore 60, either right or left handed threads. The threaded member 58 (FIGS. 19 and 20) has a head portion 68 at one end and a gripping member portion 70 at the other end thereof, the gripping member portion 70 is illustrated as a recess 72 having a polygonal side wall 74. A shank portion 76 extends between the head portion 68 and the gripping member portion 70 of the threaded member 58, which shank portion 76 has a first threaded portion 78, adjacent the head portion 68, having threads 80 which are engageable with the threads 62 of the first threaded bore 60 of the first wedge shaped member 46, and a second threaded portion 82, adjacent the gripping member portion 70, having threads 84 which are engageable with the threads 66 of the second threaded bore 64 of the second wedge shaped member 48. Between the first threaded portion 78 and the second threaded portion 82 of the threaded member 58 there is provided an unthreaded portion 86 in the presently preferred embodiment of the invention.

Figure 16:
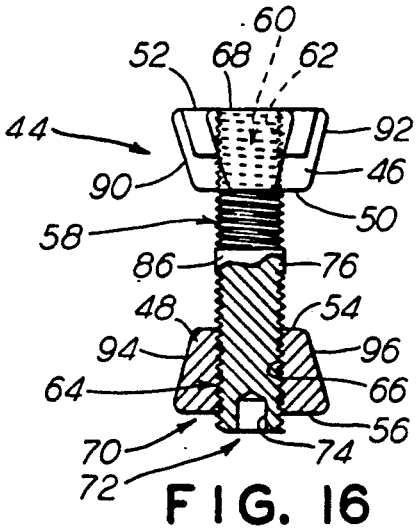
FIG. 16 is an end view of the adjustable securing device with the lower portion shown in cross-section taken along the line XVI—XVI of FIG. 13 taken along the lines XVI—XVI of FIG. 13.
Figure 17:
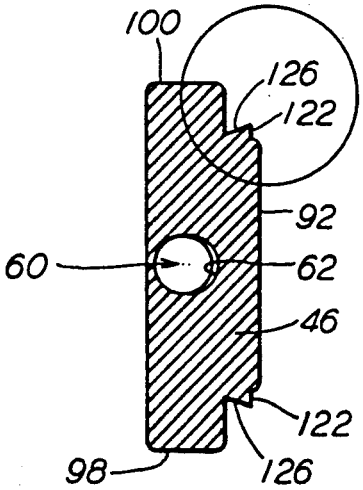
FIG. 17 is a cross-sectional view taken along the lines XVII—XVII of FIG. 15.

The first wedge shaped member 46 has a pair of end wall portions 90 and 92, at least one of which converges towards the other from such outer wall portion 52 to such inner wall portion 50, with preferably both of the end wall portions 90 and 92 so converging. The second wedge shaped member 48 also has a pair of end wall portions 94 and 96, at least one of which converges towards the other from such outer wall portion 56 to such inner wall portion 54, with preferably both of the end wall portions 94 and 96 so converging, as shown in FIG. 16. The wedge shaped members 46 and 48 also have side wall portions 98 and 100 and 102 and 104 respectively.

Figure 7:
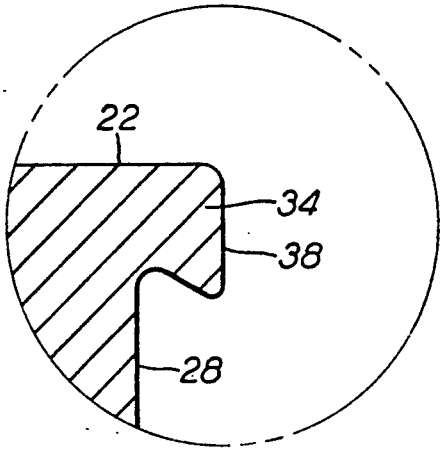
FIG. 7 is an enlarged view of the area of the flange portion of the end block illustrated in Circle VII of FIG. 4.
Figure 8:
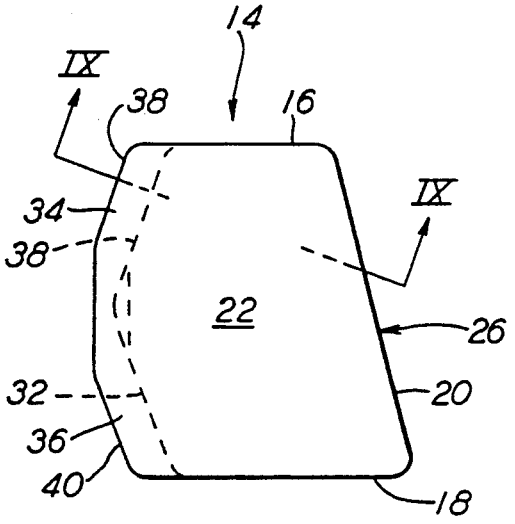
FIG. 8 is a side elevational view of the other of the pair of spaced end blocks.
Figure 10:
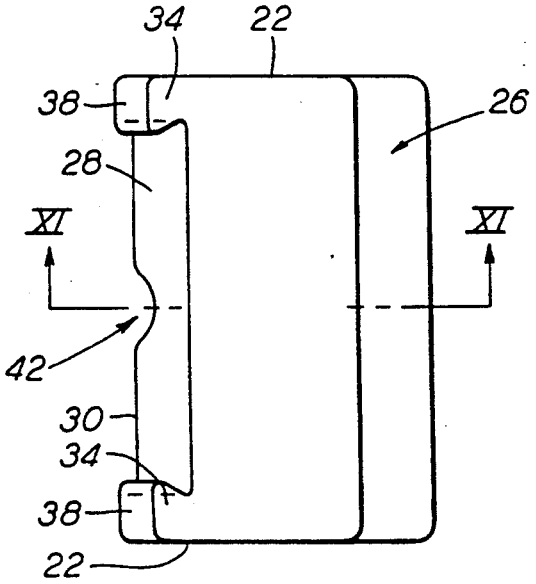
FIG. 10 is a top plan view of the end block illustrated in FIG. 8.
Figure 11:
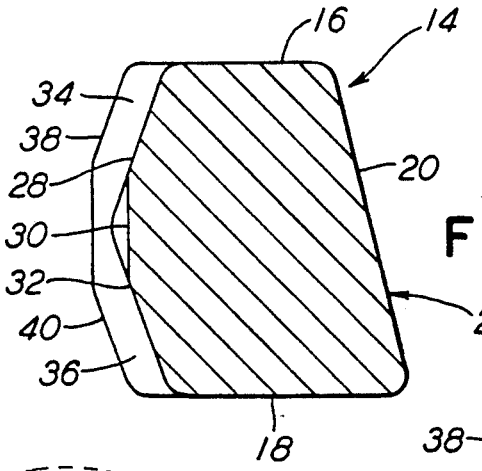
FIG. 11 is a cross-sectional view taken along line XI—XI of FIG. 10.
Figure 12:
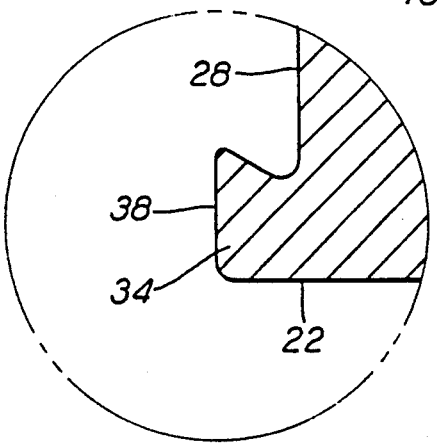
FIG. 12 is an enlarged view of the area of the flange portion of the end block illustrated in the Circle XII of FIG. 9.
Figure 9:
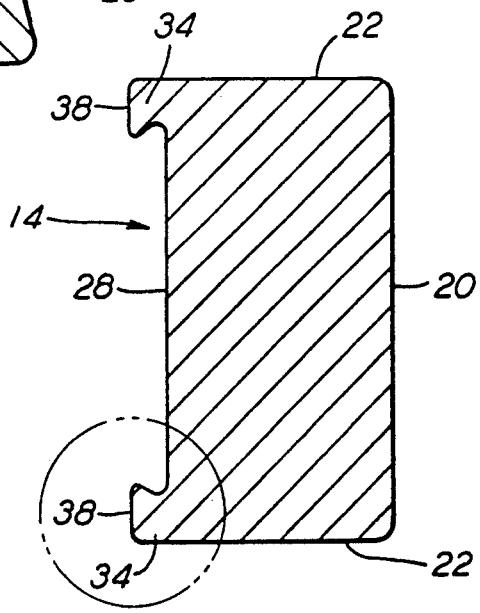
FIG. 9 is a cross-sectional view taken along lines IX—IX of FIG. 8.
Figure 13:
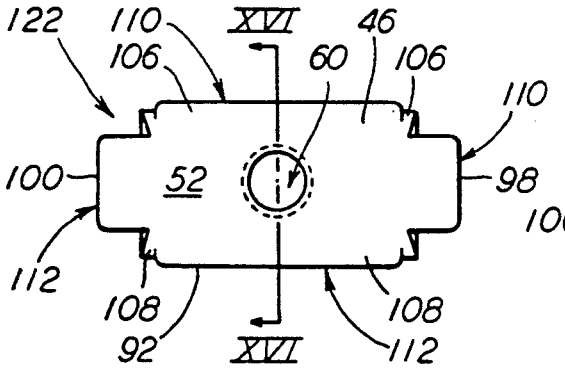
FIG. 13 is a top plan view of the adjustable securing device as in the adjustable blockout apparatus of a presently preferred embodiment of the present invention.
Figure 14:
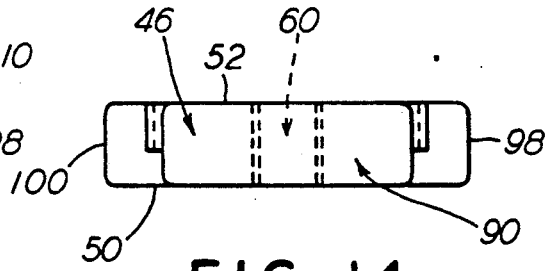
FIG. 14 is a side elevational view of one of the spaced wedge member.
Figure 15:
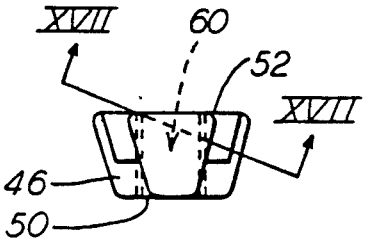
FIG. 15 is an end view of one of the spaced wedge members.
Figure 18:
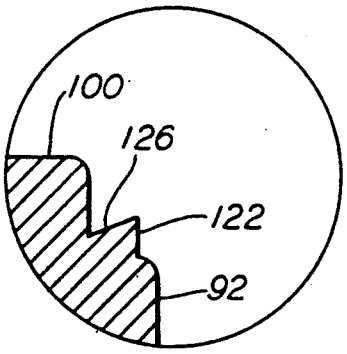
FIG. 18 is a view of a presently preferred dove tail engagement on a wedge member taken from the circle XVIII of FIG. 17.
Figure 21:
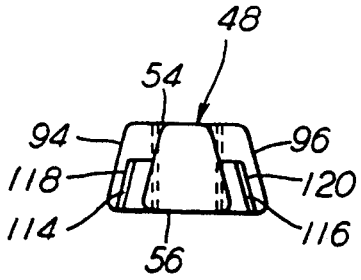
FIG. 21 is an end view of the other of the spaced wedge members.
Figure 19:
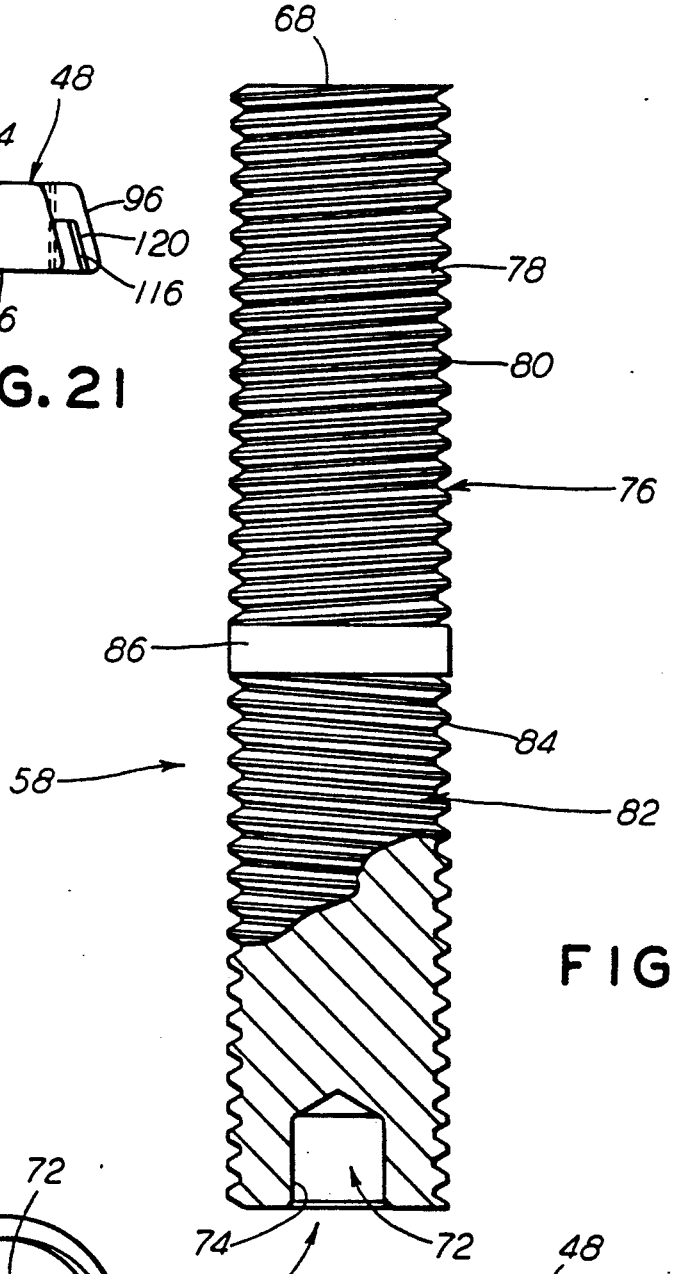
FIG. 19 is an elevational view, partly in cross-section, illustrating a threaded member usable in the adjustable securing device of the adjustable blockout apparatus of the present invention.
Figure 20:
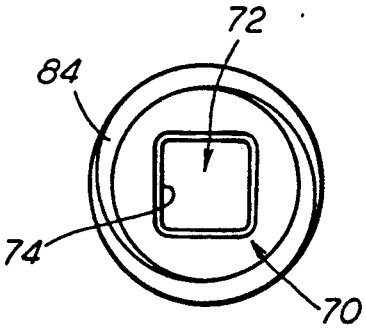
FIG. 20 is an end view of the threaded member of FIG. 19 illustrating a gripping member.
Figure 22:
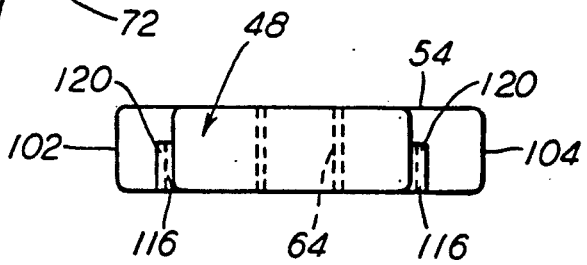
FIG. 22 is a side elevational view of the other of the spaced wedge members.

On the first wedge shaped member 46, each end wall portion 90 and 92 has at each of its ends an outwardly extending first tongue or tenon 106 and 108, respectively, which has an outer surface 110 and 112, respectively, that is contiguous to the adjacent end wall portion and complementary with the inclined surface 28 of the confronting end faces 24 of spaced end blocks 12 and 14, while on the second wedge shaped member 48, each end wall portion 94 and 96 has at each of its ends an outwardly extending second tongue 114 and 116, respectively, which has a surface 118 and 120, respectively, that is contiguous to the adjacent end wall portion and complementary with the inclined surface 32 of the confronting end faces 24 of the spaced end blocks 12 and 14. The end wall portions of the wedge shaped members together with the adjacent tongues comprise a dovetail tenon which fits in the dovetail mortise formed by the end faces 28 and 32 respectively of the spaced end blocks and the undercut portions of the flanges 34 and 36. The end wall portions 90 and 92 of the wedge shaped member 46 and the end wall portions 94 and 96 of the wedge shaped member 48 are shorter than the distance from side wall portions 98 and 102 respectively to side wall portions 100 and 104 respectively so that wedge shaped members 46 and 48 can nest between the flanges 34 and 36 of the spaced end blocks 12 and 14 with the surfaces of end walls 90 and 92 and 102 and 104 respectively in proximate and complementary contact with the inclined faces 28 and 32 respectively of the spaced end blocks. The ends of end wall portions 90, 92, 94 and 96 are undercut as shown at 126 in FIG. 1 to form a dovetail tenon and the surfaces 28 and 32, of the spaced end blocks, together with the undercut surfaces 124 of the flanges form a complementary dovetail mortise, said mortise and tenon being slidably engageable with each other. The mortise and tenon serving to adjustably connect the spaced end blocks to the wedge shaped members and to be moved toward and away from each other as the wedge shaped members are moved away or toward each other by rotation of the threaded member 58. The edges or corners of tongues 106, 108, 114, and 116 preferably are recessed from the end walls, and a key member 122 extends outwardly from the edges. As best seen in FIG. 18, the surface 112 of key member 122 may be recessed from the surface of end wall portion 92 so that key member 122 with end wall portion 92 comprises a dovetail tenon which will interlock with the dovetail mortise formed by surfaces 28 of spaced end blocks 12 and 14 and the angular face 124 on flanges 34. Corresponding surfaces 110, 118, and 120 of tongues or tenons 106, 114, and 116 are also recessed so that similar key members are formed at each of the end walls. With this construction, key members 122 will not bear any of the service load applied to the blockout device, such loads being transmitted from spaced end blocks 12 and 14 by contact between surfaces 28 and 32 respectively of the spaced end blocks with the surfaces of end wall portions 90 and 92 of wedge shaped member 46 and end wall portions 94 and 96 of wedge shaped member 48. In addition to recessing the surfaces of the key members 122 as described above, the inside and outside corners of the inter-locking key members and flanges may be rounded as best seen in FIGS. 7 and 18. This construction helps to avoid sticking and binding as the dovetail members are moved relative to each other during adjustment of the blockout apparatus. As shown in FIG. 1, flanges 34 on the spaced end blocks 12 and 14 have an angular face 124, with the key members designed to be slidably engaged with the flanges 34, with a complementary angular surface 126 provided on the key member which slides along the angular face 124 of the flanges 34.

While a presently preferred and a number of alternative embodiments of the present invention have been described in detail above it should be obvious that those persons who are skilled in the railway coupling art can make various other modifications and adaptations to the axially adjustable blockout device of the present invention without departing from the spirit and scope of the appended claims.

We claim:

1. A yoke draft gear pocket axially adjustable blockout apparatus positionable within such yoke draft gear pocket which is disposed within a center sill member mounted on a railway freight car body, to enable equipping of such railway car with a slackless drawbar coupling arrangement, said axially adjustable blockout apparatus comprising:

(a) a pair of spaced end blocks, each of said pair of spaced end blocks having a top wall portion, a bottom wall portion, a pair of end wall portions, a pair of side wall portions, and confronting end faces, each said confronting end face having a pair of inclined surfaces along at least a portion thereof converging from a respective said top wall portion and from said bottom wall portion towards an intermediate section of said end face;

(b) a pair of spaced wedge shaped members disposed between said pair of said spaced end blocks, each of said pair of said spaced wedge shaped members having a pair of side wall portions, an outer wall portion and an inner wall portion, with each said inner wall portion confronting each other, and a pair of end wall portions converging from said outer wall portion towards said inner wall portion;

(c) a threaded means engagable with each of said pair of said spaced wedge shaped members for adjustably securing said confronting pair of said spaced wedge shaped members together; and (d) means for slidably connecting said pair of said spaced wedge shaped members with said pair of said spaced end blocks, with each of said converging end wall portions of said spaced wedge shaped members contacting a said inclined surface of a confronting end face of a said spaced end block.

2. A yoke draft gear pocket axially adjustable blockout apparatus, according to claim 1, wherein a said end wall of one of said pair of said spaced end blocks includes an angular surface extending at an acute angle from said bottom wall portion to said top portion wall thereof.

3. A yoke draft gear pocket axially adjustable blockout apparatus, according to claim 2, wherein both of said end walls of said pair of said spaced end blocks include an angular surface extending at an acute angle from said bottom wall portion to said top wall portion thereof.

4. A yoke draft gear pocket axially adjustable blockout apparatus, according to claim 1, wherein coaxial threaded bores are provided through each of said pair of said spaced wedge shaped members and said means for adjustable securing said confronting pair of said spaced wedge shaped members together comprises a threaded member extending between and threadably engaged with said coaxial threaded bores in said pair of said spaced wedge shaped members.

5. A yoke draft gear pocket axially adjustable blockout apparatus, according to claim 1, wherein said means for slidably connecting said pair of said spaced wedge shaped members with said pair of said spaced end blocks comprises flanges on at least one of: (a) said confronting end faces of said spaced end blocks, extending outwardly from said confronting end faces towards each other, and (b) said means on said end wall portions of said wedge shaped members extending outwardly from said converging end walls, and an engaging tongue on said other of said (a) confronting end faces of said spaced end blocks extending outwardly from said confronting end faces towards each other, and (b) said means on said pair of said end wall portions of said wedge shaped members extending outwardly from said converging end walls.

6. A yoke draft gear pocket axially adjustable apparatus, according to claim 1, wherein said means for slidably connecting said pair of said spaced wedge shaped members with said pair of said spaced end blocks comprises flanges on said confronting end faces of said spaced end blocks adjacent said side wall portions thereof, extending outwardly from said confronting end faces toward each other, and a tongue on each of said end wall portions of said wedge shaped members, extending outwardly from said end wall, slidably engageable with said flanges.

7. A yoke draft gear pocket axially adjustable blockout apparatus, according to claim 6, wherein key members are provided on edges of each said tongue which are slidable along an angular surface of said spaced wedge shaped members.

8. A yoke draft gear pocket axially adjustable blockout apparatus, according to claim 7, wherein each said tongue has an outer surface complementary with said inclined surface of said confronting end faces of said spaced end blocks and wherein said key members are recessed from said outer surface of said tongue.

9. A yoke draft gear pocket axially adjustable blockout apparatus, according to claim 1, wherein said means for adjustably securing said confronting pair of spaced wedge shaped members together includes:

(a) a head portion disposed at a first end thereof, (b) a gripping member portion disposed at an axially opposed second end thereof, and (c) a shank portion extending between said head portion and said gripping member portion, a first portion of said shank portion located adjacent said head portion, having a threaded portion engageable with said threads disposed in said first threaded bore in said first wedge shaped member and a second portion of said shank portion located adjacent said gripping member portion, having a threaded portion engageable with said threads disposed in said second threaded bore in said second wedge shaped member so that upon threading of said threaded member into said first threaded bore in said first wedge shaped member and said second threaded bore in said second wedge shaped member, said first wedge shaped member and said second wedge shaped member will be secured together and upon rotating said threaded member in a first direction with said first wedge shaped member and said second wedge shaped member being restrained from rotation they will be move toward one another and upon rotation of said threaded member in an opposite direction they will be moved apart.

10. A yoke draft gear pocket axially adjustable blockout apparatus positionable within such yoke draft gear pocket which is disposed within a center sill member mounted on a railway freight car body, to enable equipping of such railway car with a slackless drawbar coupling arrangement, said axially adjustable blockout apparatus comprising:

(a) a pair of spaced end blocks, each end block having a top wall, a bottom wall, a pair of end walls, a pair of side walls, and confronting end faces, each of said confronting end faces having a pair of inclined surfaces along at least a portion thereof converging from said top wall and said bottom wall towards an intermediate section of said end face;

(b) a pair of first and second spaced wedge members disposed between said spaced end blocks, each of said pair of wedge members having side walls, an outer wall and an inner, with said inner walls confronting each other, and end walls converging from said outer wall towards said inner wall;

(c) means for slidably connecting said pair of spaced wedge members with said pair of end blocks 5, with each of said converging end walls of said spaced wedge members contacting a said inclined surface of a confronting end face of a said end block;

(d) a first threaded bore disposed in said first wedge member and extending therethrough between said inner and outer walls thereof;

(e) a second threaded bore disposed in said second wedge member and extending therethrough between said inner and outer walls thereof and coaxially aligned with said first threaded bore and having threads of an opposite direction to the threads of said first threaded bore;

(f) a threaded member extending into said first threaded bore and said second threaded bore of said spaced wedge members, said threaded member having a head at one end , a gripping member at an opposite end, and a shank portion extending between said head and said gripping member;

(g) a first portion of said shank portion adjacent said head, having a threaded portion engageable with threads in said first threaded bore; and (h) a second portion of said shank portion, adjacent said gripping member having a threaded portion engageable with threads in said second threaded bore; and (i) whereby, upon threading of said threaded member into said threaded bores of said spaced wedge members, said pair of confronting spaced wedge members will be secured together and upon rotating said threaded member in one direction, with said spaced wedge members restrained from rotation, said pair of spaced wedge members will be moved together, while upon rotating said threaded member in an opposite direction said pair of said spaced wedge members will be moved apart.

11. A yoke draft gear pocket axially adjustable blockout apparatus, according to claim 10, wherein a said end wall of one of said pair of said spaced end blocks has an angular surface extending at an acute angle from said bottom wall portion to said top wall portion thereof.

12. A yoke draft gear pocket axially adjustable blockout apparatus, according to claim 11, wherein both end walls of said pair of said spaced end blocks have an angular surface extending at an acute angle from said bottom wall portion to said top wall portion thereof.

13. A yoke draft gear pocket axially adjustable blockout apparatus, according to claim 10, wherein said first and second wedge members have at least one end wall which converges from said outer wall towards said inner wall thereof.

14. A yoke draft gear pocket axially adjustable blockout apparatus; according to claim 10, wherein said first and second wedge members both have end walls which converge from the said respective outer wall towards said respective inner wall thereof.

15. A yoke draft gear pocket axially adjustable blockout apparatus, according to claim 10, wherein both said first and second wedge members have a pair of end walls which converge from said outer wall towards said inner wall.

16. A yoke draft gear pocket axially adjustable blockout apparatus, according to claim 10, wherein said gripping member comprises a recess.

17. A yoke draft gear pocket axially adjustable blockout apparatus, according to claim 16 wherein said recess has a polygonal side wall.

18. A yoke draft gear pocket axially adjustable blockout apparatus, according to claim 10, wherein said threaded member has an unthreaded section between said first threaded portion and said second threaded portion.

19. A yoke draft gear pocket axially adjustable blockout apparatus, according to claim 10, wherein said means for slidably connecting said pair of said spaced wedge members with said pair of said end blocks includes a tongue on each end wall of said wedge members.

* * * * *

UNITED STATES PATENT AND TRADEMARK OFFICE

CERTIFICATE OF CORRECTION

PATENT NO. : 5,190,173

DATED : MARCH 2, 1993

INVENTOR(S) : PETER SCOTT MAUTINO

It is certified that error appears in the above-identified patent and that said Letters Patent is hereby corrected as shown below:

Column 3, line 8, delete "sport" and insert --apart--.

Column 4, line 29, delete "." and insert --;--.

Column 8, line 18, delete "adjustable" and insert --adjustable--.

Column 10, line 33, delete "adjustable" and insert --adjustable--.

Signed and Sealed this

Second Day of August, 1994

*Attest:*

Bruce Lehman

BRUCE LEHMAN

*Attesting Officer*

*Commissioner of Patents and Trademarks*